US009091955B2

(12) United States Patent
Seki

(10) Patent No.: US 9,091,955 B2
(45) Date of Patent: Jul. 28, 2015

(54) IMAGE FORMING APPARATUS

(71) Applicant: CANON KABUSHIKI KAISHA, Tokyo (JP)

(72) Inventor: Yuichi Seki, Saitama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/305,584

(22) Filed: Jun. 16, 2014

(65) Prior Publication Data

US 2015/0002600 A1 Jan. 1, 2015

(30) Foreign Application Priority Data

Jun. 28, 2013 (JP) ..... 2013-137468

(51) Int. Cl.
*B41J 15/04* (2006.01)
*G03G 15/04* (2006.01)
*G03G 15/043* (2006.01)

(52) U.S. Cl.
CPC ..... *G03G 15/04072* (2013.01); *G03G 15/0435* (2013.01); *G03G 2215/0141* (2013.01)

(58) Field of Classification Search
CPC ..... G03G 15/04072; G03G 15/0435; G03G 2215/0141
USPC ..... 347/235, 236, 224, 249
See application file for complete search history.

(56) References Cited

U.S. PATENT DOCUMENTS

| | | | | |
|---|---|---|---|---|
| 6,560,256 | B1 | 5/2003 | Seki et al. | 372/38.02 |
| 6,919,979 | B2 | 7/2005 | Seki et al. | 359/204 |
| 7,106,770 | B2 * | 9/2006 | Seki | 372/43.01 |
| 7,129,967 | B2 | 10/2006 | Seki et al. | 347/249 |
| 7,586,511 | B2 | 9/2009 | Seki et al. | 347/249 |
| 2008/0051044 | A1 | 2/2008 | Takehara | 455/127.2 |
| 2011/0234737 | A1 * | 9/2011 | Gentner et al. | 347/224 |
| 2012/0268723 | A1 | 10/2012 | Seki | 355/67 |
| 2015/0002598 | A1 * | 1/2015 | Furuta | 347/133 |

FOREIGN PATENT DOCUMENTS

JP 2008-028509 2/2008

* cited by examiner

*Primary Examiner* — Sarah Al Hashimi
(74) *Attorney, Agent, or Firm* — Fitzpatrick, Cella, Harper & Scinto

(57) ABSTRACT

An image forming apparatus controls a semiconductor laser such that first and second light beams among multiple light beams are successively incident on a BD sensor and measures the time interval between BD signals that correspond to the first and second light beams and are output from the BD sensor. Two light emitting elements that output two light beams for which the ratio between the light powers of two light beams detected by the detection unit falls within a predetermined range are set as light emitting elements that are to emit the first and second light beams when the time interval is to be measured. This suppresses measurement errors when measuring the interval between light beams emitted from two light emitting elements and improves correction accuracy for the image writing start positions of the light emitting elements.

9 Claims, 12 Drawing Sheets

IMAGE FORMING APPARATUS

BACKGROUND OF THE INVENTION

1. Field of the Invention

The present invention relates to an electrophotographic image forming apparatus.

2. Description of the Related Art

Conventionally, there are known to be optical scanning apparatuses included in image forming apparatuses which employ a method of using a polygon mirror to deflect a group of light beams emitted from a semiconductor laser that includes multiple light emitting elements (light emitting units) and irradiate a photosensitive member (photosensitive drum) with the deflected light beams. With this kind of optical scanning apparatus, there are cases where the light beams emitted from the light emitting elements form images at positions on the photosensitive member that are different in the main scanning direction. In such a case, the writing start positions in the main scanning direction of the electrostatic latent images that are to be formed by the light beams emitted from the light emitting elements need to coincide with each other in the sub-scanning direction. To achieve this, a method is known in which two light beams emitted from two specific light emitting elements are detected by an optical sensor, and the light beam emission timings of the light emitting elements are controlled based on the result of measuring the time interval between detection signals output from the sensor.

For example, Japanese Patent Laid-Open No. 2008-28509 discloses an optical scanning apparatus that scans the surface of a photosensitive member with multiple light beams by using an optical deflector to deflect light beams emitted from light emitting points in a light source including three or more light emitting points arranged linearly at a predetermined interval. The optical scanning apparatus disclosed in the patent document above measures the interval between the two scanning lines arranged the farthest from one another in the sub-scanning direction among the scanning lines corresponding to the light beams and adjusts the interval between the scanning lines in the sub-scanning direction.

However, in the case of detecting at least two light beams with the optical sensor and measuring the time interval between the detection signals output from the optical sensor as described above, there is a possibility that the light powers of the light beams will decrease due to the optical system on the optical axis from when a light beam is emitted from a light emitting element until it reaches the optical sensor. In such a case, there is a possibility that an error will occur in the measurement result for the time interval.

Here, FIG. 1B is a diagram showing a relationship between the light powers of eight light beams emitted from eight light emitting elements with respect to the main scanning direction in the case where the semiconductor laser includes eight light emitting elements ($LD_1$ to $LD_8$). Note that with respect to the main scanning direction, the position at which the optical sensor is arranged (beam detection position) is shown as the reference (0 mm), and the light beam corresponding to $LD_1$ is shown as the light beam that precedes the other light beams in the main scanning direction. Also, FIG. 1A is a diagram showing a relationship between the delay time for a signal output from the optical sensor and the light power of a light beam incident on the optical sensor.

As shown in FIG. 1B, the light beams corresponding to $LD_4$ to $LD_8$ can be detected by the optical sensor at 100% of their light powers (normalized using the maximum value) at the beam detection position. On the other hand, the light beam corresponding to $LD_1$ can only be detected by the optical sensor at around 60% of its light power at the beam detection position. This is because a portion of the light beam (optical flux) corresponding to $LD_1$ is lost due to the light beam corresponding to $LD_1$ being incident on the end portion of the reflecting surface of the polygon mirror that is arranged on the optical axis and deflects the light beam. In the case where the light power of the light beam incident on the optical sensor decreases from 100% to 60% in this way, the delay time for the output signal of the optical sensor is extended by about 0.05 μs, as shown in FIG. 1A.

Accordingly, in a case where the light powers of light beams, which are used to measure the time interval between detection signals output from the optical sensor, at the time of being incident on the optical sensor decreases due to the optical system as described above, variation occurs in the difference in the delay time between the light beams when the detection signals are output from the optical sensor. As a result, there is a possibility that an error will occur in the measurement result for the time interval between the detection signals output from the optical sensor, and the correction accuracy for the light beam emission timings will deteriorate.

SUMMARY OF THE INVENTION

The present invention has been made in view of the above-mentioned problem. The present invention in one aspect provides a technique, in an optical scanning apparatus including multiple light emitting elements, of suppressing measurement errors when measuring an interval between light beams emitted from two light emitting elements, and improving correction accuracy for the image writing start positions of the light emitting elements.

According to one aspect of the present invention, there is provided an image forming apparatus that exposes a photosensitive member using a plurality of light beams, the image forming apparatus comprising: a light source that includes a plurality of light emitting elements that each emit a light beam, the light source including at least three light emitting elements; a deflection unit configured to deflect the plurality of light beams emitted from the plurality of light emitting elements, such that the plurality of light beams scan the photosensitive member; a detection unit that is provided on a scanning path of the plurality of light beams deflected by the deflection unit, and is configured to output a detection signal indicating that a light beam deflected by the deflection unit has been detected due to the light beam being incident on the detection unit; a measurement unit configured to control the light source such that a first and second light beam are successively incident on the detection unit, and to measure a time interval between detection signals that are output from the detection unit and corresponds to the first and second light beams; and a control unit configured to, according to the time interval measured by the measurement unit, control relative emission timings for light beams from the plurality of light emitting elements that are based on image data, wherein among the plurality of light emitting elements, two light emitting elements are set as light emitting elements that are to emit the first and second light beams, the two light emitting elements outputting two light beams for which a ratio between light powers of the two light beams detected by the detection unit falls within a predetermined range.

According to the present invention, it is possible to provide a technique, in an optical scanning apparatus including multiple light emitting elements, of suppressing measurement errors when measuring an interval between light beams emitted from two light emitting elements, and improving correction accuracy for the image writing start positions of the light emitting elements.

Further features of the present invention will become apparent from the following description of exemplary embodiments with reference to the attached drawings.

DESCRIPTION OF THE EMBODIMENTS

Hereinafter, embodiments of the present invention will be described in detail with reference to the accompanying drawings. It should be noted that the following embodiments are not intended to limit the scope of the appended claims, and that not all the combinations of features described in the embodiments are necessarily essential to the solving means of the present invention.

Embodiments will be described below taking the example of an electrophotographic image forming apparatus that forms multi-color (full-color) images using multiple colors of toner (developing material). Note that the embodiments can be applied to an image forming apparatus that forms monochrome images using only a single color of toner (e.g., black).

Configuration of Image Forming Apparatus

Figure 8:
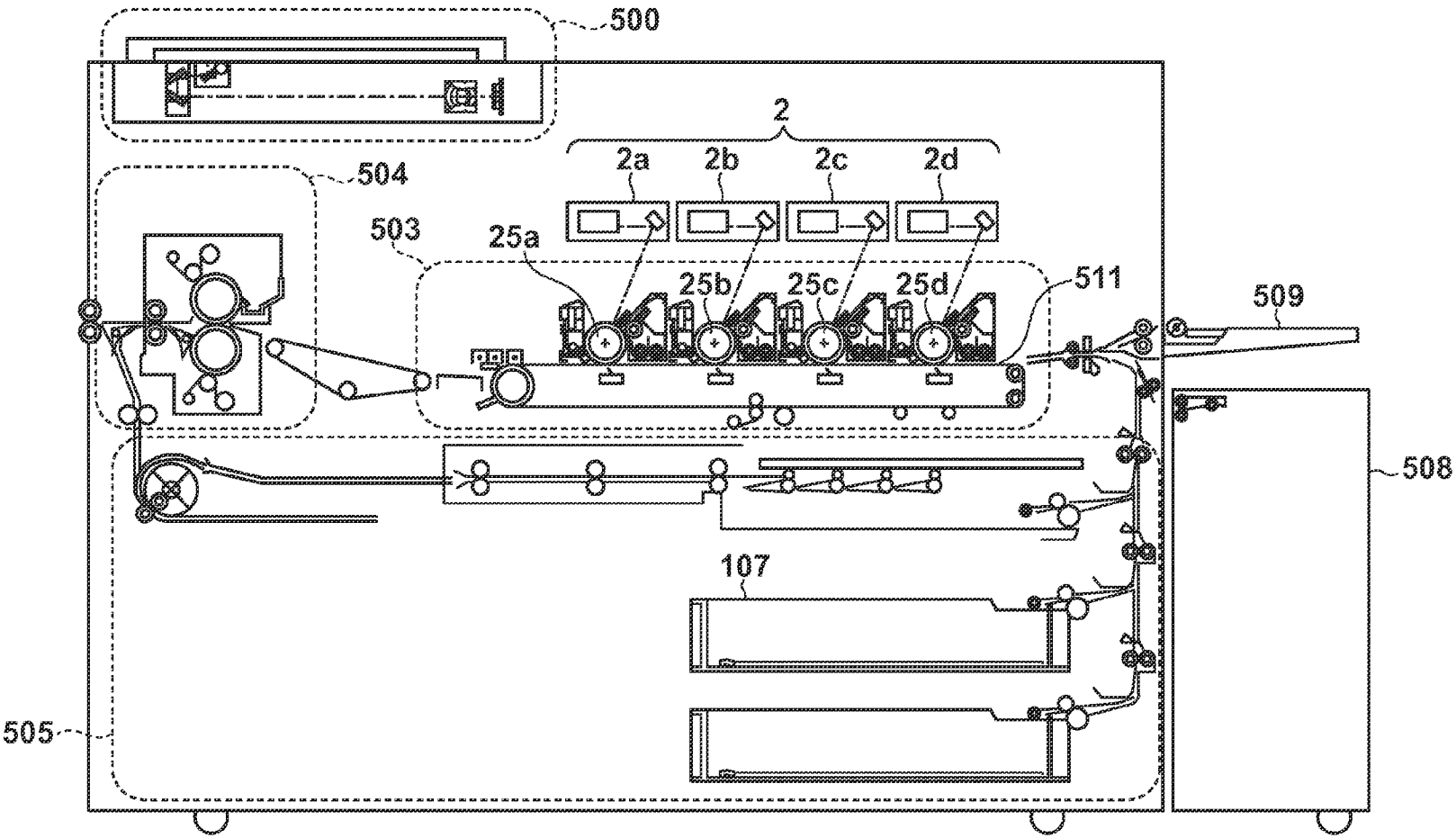
FIG. 8 is a diagram showing an example of a schematic configuration of an image forming apparatus 1 according to an embodiment.

First, a configuration of an image forming apparatus 1 according to an embodiment will be described with reference to FIG. 8. The image forming apparatus 1 includes an image forming unit 503, an image reading unit 500, an optical scanning unit 2 (2*a*, 2*b*, 2*c*, 2*d*), photosensitive drums 25 (25*a*, 25*b*, 25*c*, 25*d*), a fixing unit 504, a paper supplying/conveying unit 505, and a control unit (not shown) that controls these units. The image reading unit 500 optically reads an image of a document placed on a document platen and converts the image into an electrical signal, thereby generating image data corresponding to the image of the document. The image forming unit 503 forms an image (toner image) on a recording medium such as a sheet using yellow (Y), magenta (M), cyan (C), and black (Bk) toner. Note that Y, M, C, and Bk images are formed on the photosensitive drums (photosensitive members) 25*a*, 25*b*, 25*c*, and 25*d* (on the surfaces thereof) respectively.

In the image forming unit 503, first, multiple chargers that correspond to the photosensitive drums 25*a*, 25*b*, 25*c*, and 25*d*, which are driven so as to be rotated, charge the corresponding photosensitive drums (the surfaces thereof). The optical scanning units (exposure units) 2*a*, 2*b*, 2*c*, and 2*d* respectively scan the photosensitive drums 25*a*, 25*b*, 25*c*, and 25*d* (the surfaces thereof) using light beams in accordance with the image data. According to this, the photosensitive drums 25*a*, 25*b*, 25*c*, and 25*d* are exposed to the light beams. In this way, the electrostatic latent images of the respective colors corresponding to the image data are formed on the photosensitive drums 25*a*, 25*b*, 25*c*, and 25*d* (the surfaces thereof) by means of the scanning of the multiple light beams performed by the optical scanning units 2*a*, 2*b*, 2*c*, and 2*d* respectively. In the image forming unit 503, multiple developers that correspond to the photosensitive drums 25*a*, 25*b*, 25*c*, and 25*d* develop the electrostatic latent images formed on the corresponding photosensitive drums using Y, M, C, and Bk toner respectively. According to this, images of the respective colors (toner images) that are to be transferred onto the recording medium are formed on the photosensitive drums 25*a*, 25*b*, 25*c*, and 25*d*.

The images of the respective colors formed on the photosensitive drums 25*a*, 25*b*, 25*c*, and 25*d* are transferred in an overlaid manner onto the recording material. Specifically, in the process in which a recording medium supplied from a manual feed tray 509, a large-capacity stacker 508, or a paper supply cassette 107 in the paper supplying/conveying unit 505 is conveyed in a state of being adsorbed onto an electrostatic adsorptive transfer belt 511, the images are transferred in an overlaid manner from each photosensitive drum 25 onto the recording medium in order. According to this, a multi-color image is formed on the recording medium. After the multi-color image is formed on the recording medium, the recording medium is conveyed to the interior of the fixing unit 504 and fixing processing is carried out. The fixing unit 504 is constituted by a combination of a roller and a belt, is equipped with a heat source such as a halogen heater, and causes the toner on the recording medium to be fixed to the recording medium using heat and pressure.

Configuration of Optical Scanning Apparatus

Figure 9:
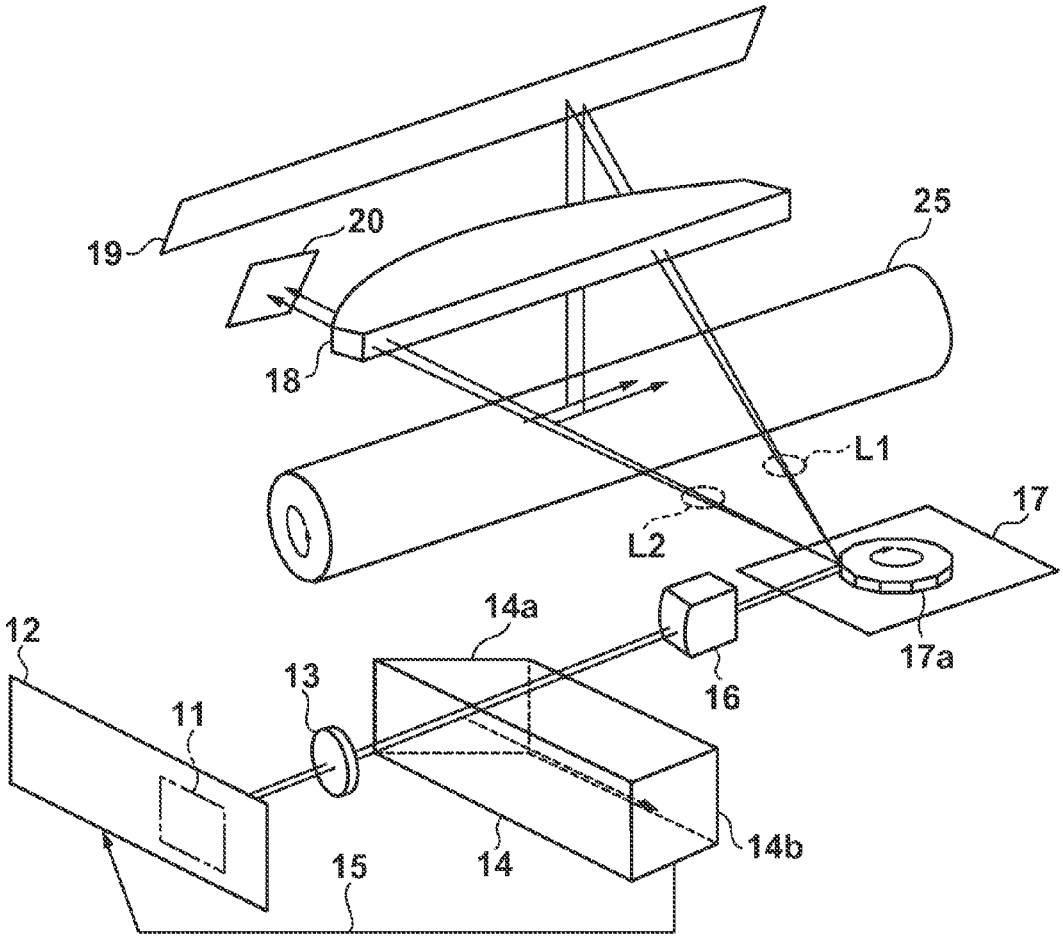
FIG. 9 is a diagram showing an example of a configuration of an optical scanning unit 2 according to an embodiment.

The configuration of the optical scanning unit 2 will be described next with reference to FIG. 9. The optical scanning unit 2 includes the components shown in FIG. 9 except for the photosensitive drum 25. That is to say, the optical scanning unit 2 includes the semiconductor laser 11, a laser driving circuit 12, a collimator lens 13, a light power detection (PD) unit 14, a cylindrical lens 16, a scanner motor unit 17, a polygon mirror 17*a*, an f-θ lens 18, a reflection mirror 19, and a beam detection (BD) sensor 20. In the present embodiment, the semiconductor laser 11 is an example of a light source that includes multiple light emitting elements that each emit a light beam.

The semiconductor laser 11 includes multiple laser diodes (LDs) as light emitting elements (light emitting points) that each emit a light beam (laser beam), and can emit multiple light beams from the LDs at the same time. The laser driving circuit 12 performs drive control for the semiconductor laser 11 (the LDs thereof) by means of a driving current supplied to the LDs in the semiconductor laser 11. Light beams emitted from the semiconductor laser 11 become parallel beams by passing through the collimator lens 13 and are subsequently incident on the PD unit 14.

The PD unit 14 internally includes the reflection mirror 14*a* and also includes the PD sensor (light power detector) 14*b* on the beam output surface. The reflection mirror 14*a* has a characteristic of partially reflecting the light beams from the semiconductor laser 11. An light beam reflected by the reflection mirror 14*a* is received by the PD sensor 14*b*. Upon receiving the light beam, the PD sensor 14*b* outputs a PD current 15 (light power detection signal) that corresponds to the light power (intensity) of the received light beam to the laser driving circuit 12. In order for the semiconductor laser 11 to output a light beam having a predetermined light power, the laser driving circuit 12 performs automatic power control (APC), by which the driving current that is to be supplied to the semiconductor laser 11 is adjusted (controlled) based on the PD current 15 that was output from the PD unit 14.

After the light beams have been emitted from the semiconductor laser 11 and have passed through the PD unit 14, they furthermore pass through the cylindrical lens 16 and reach the polygon mirror 17*a*. The polygon mirror 17*a* rotates at a constant angular speed due to being driven by the scanner motor unit 17 that includes a scanner motor. The polygon mirror 17*a* is a rotating polygonal mirror that deflects light beams while rotating at a constant angular speed. The polygon mirror 17*a* deflects the light beams emitted from the semiconductor laser 11 (the LDs thereof) such that the light beams scan the photosensitive drums 25. The light beams deflected by the polygon mirror 17*a* are incident on the f-θ lens 18.

Among the light beams that are incident on the f-θ lens 18, a light beam L1 scans and exposes the image region of the photosensitive drum 25 in a light beam scanning period. Also, a light beam L2 is a light beam that scans a region on the photosensitive drum 25 that is not an image region (non-image region) in a light beam scanning period, and corresponds to a light beam at the end of the light beam scanning range.

After passing through the f-θ lens 18, the light beam L1 is reflected by the reflection mirror 19 and reaches the photosensitive drum 25. The f-θ lens 18 is a lens that has a function of performing speed conversion such that the trajectory of the light beam L1 moves uniformly on the photosensitive drum 25 in a direction (main scanning direction of the light beam L1, i.e., a direction parallel with the rotation axis of the photosensitive drum 25) that is perpendicular to the rotation direction of the photosensitive drum 25 (sub-scanning direction of the light beam L1). In this way, the photosensitive drum 25 is irradiated with the light beam L1 that was emitted from the semiconductor laser 11, and thereby an electrostatic latent image is formed on the photosensitive drum 25.

On the other hand, after passing through the f-θ lens 18, the light beam L2 is reflected by the reflection mirror 19 and reaches the BD sensor 20. The BD sensor 20 is provided on the scanning path of the light beams that have been emitted from the semiconductor lens 11 and deflected by the polygon mirror 17*a*. When the light beam L2 that was deflected by the polygon mirror 17*a* is incident on the light receiving surface of the BD sensor 20, a detection signal (BD signal) indicating that a light beam was detected is output by the BD sensor 20 as a synchronization signal (horizontal synchronization signal). The image forming apparatus 1 controls the LD turning-on timings that are based on the image data, by using BD signals output from the BD sensor 20 as a reference. In the present embodiment, the BD sensor 20 is an example of a detection unit.

Configuration of Semiconductor Laser

Figure 10A:
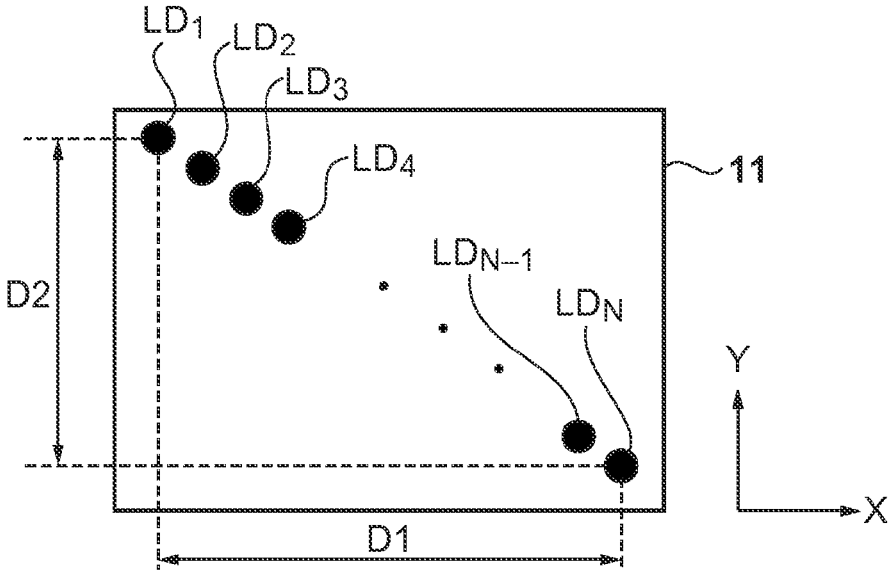
FIGS. 10A and 10B are diagrams showing an example of a configuration of the semiconductor laser 11 according to an embodiment.
Figure 10B:
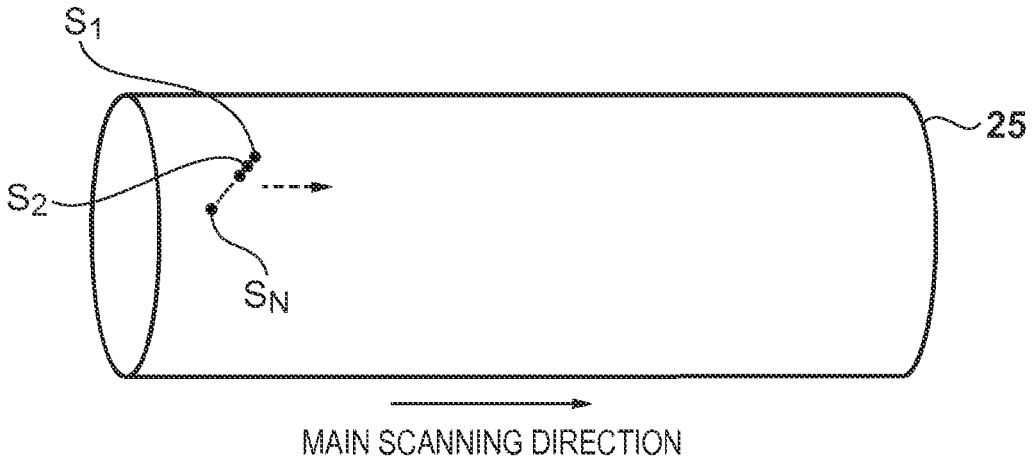

The configuration of the semiconductor laser 11 will be described next with reference to FIGS. 10A and 10B. FIGS. 10A and 10B show an example of the semiconductor laser 11 that is included in the optical scanning unit 2 of the image forming apparatus 1 as a light source. The semiconductor laser 11 includes multiple light emitting elements ($LD_1$ to $LD_N$) arranged in a row on a plane that includes an X axis and a Y axis (an XY plane). Note that the X axis direction corresponds to the main scanning direction, and the Y axis direction corresponds to the rotation direction of the photosensitive drum 25 (sub-scanning direction). With this kind of image forming apparatus, the interval between the light emitting elements in the Y axis direction is adjusted by rotating the semiconductor laser 11 in the XY plane shown in FIG. 10A in the assembly step at the factory. According to this, the interval in the sub-scanning direction between the scanning lines on the photosensitive drum 25 (interval between exposure positions), which are created by the light beams emitted from the light emitting elements, can be adjusted such that it corresponds to a predetermined resolution.

When the semiconductor laser 11 is rotated in the XY plane shown in FIG. 10A, the interval between the light emitting elements in the Y axis direction changes, and the interval between the light emitting elements in the X direction changes as well. According to this, the light beams emitted from the light emitting elements each form an image on the photosensitive drum 25 at different positions $S_1$ to $S_N$ in the main scanning direction, as shown in FIG. 10B. For this reason, in the image forming apparatus 1, the writing start positions in the main scanning direction for the electrostatic latent images that are to be formed on the photosensitive drums 25 by the light beams emitted from the light emitting elements of the semiconductor laser 11 need to coincide with each other in the sub-scanning direction.

The image forming apparatus 1 (optical scanning unit 2) according to the present embodiment generates two BD signals based on light beams emitted from two light emitting elements among the light emitting elements ($LD_1$ to $LD_N$) and uses the generated BD signals to control the relative timings for laser emission from the light emitting elements that is based on the image data.

Specifically, the image forming apparatus 1 controls the semiconductor laser 11 such that two specific light emitting elements (first and second light emitting elements) successively emit two light beams (first and second light beams) at a predetermined time interval and the two light beams are incident on the BD sensor 20. Upon detecting the two light beams, the BD sensor 20 generates the two BD signals. The image forming apparatus 1 measures the time interval between the BD signals, corresponding to the two light beams, that are output from the BD sensor 20 in correspondence with the two light beams. Furthermore, for each of the light emitting elements ($LD_1$ to $LD_N$), the emission timing of the light beam that is based on the image data is adjusted (controlled) by the image forming apparatus 1 according to the measured time interval. This kind of control can be realized by controlling the laser emission timings of the respective light emitting elements such that the positions in the main scanning direction at which the formation of the electrostatic latent image is to be started are caused to coincide with each other in the sub-scanning direction between the main scanning lines scanned by the light beams.

However, as described above, there are cases in which the light powers of the two light beams used in measurement decreases at the time of being incident on the BD sensor 20 due to the optical system (due to the light beams being incident on the end portions of the reflection surfaces of the polygon mirror 17*a*). In such a case, variation will occur in the difference in the delay time between the two light beams when the BD signals are output from the BD sensor 20. As a result, there is a possibility that an error will occur in the measurement result for the time interval between the BD signals and the correction accuracy for the light beam emission timings will deteriorate.

In view of this, the image forming apparatus 1 (optical scanning unit 2) according to the present embodiment performs the following operations at the time of measurement using the BD sensor 20 in order to control the emission timings at which the light beams based on the image data are emitted from the light emitting elements.

Among the light beams, the image forming apparatus 1 (optical scanning unit 2) performs BD signal time interval measurement (also referred to as "beam interval measurement") using two light beams (first and second light beams) for which the light power ratio at the time of being incident on the BD sensor 20 falls within a predetermined range. That is to say, the two light emitting elements that emit two light beams for which the ratio between the light powers of the two light beams detected by the BD sensor 20 falls within a predetermined range are set as the light emitting elements that are to emit the first and second light beams. Here, the predetermined range may be set as a range in which the difference in the output signal delay times of the BD signals, corresponding to the two light beams, that are output from the BD sensor 20 does not have an influence on the correction accuracy for the light beam emission timings. For example, it is possible to set the predetermined range as a range in which the difference in the output delay times of the two light beams, which occurs in the BD signals according to a change in the light power of the light beams when they are incident on the BD sensor 20, is less than a pre-defined threshold value. Thus, by performing beam interval measurement using two light beams with relatively little difference in light power when incident on the BD sensor 20, variations (errors) that occur in the measurement result of the time interval between the two BD signals due to variations in the incident light power can be reduced.

Specific embodiments for realizing the above embodiment will be described below.

Embodiment 1

In Embodiment 1, the two light beams that are to be used for beam interval measurement (first and second beams) are selected in advance, and information indicating the two selected light beams is stored in advance in a memory (storage apparatus), at the time of factory shipping of the image forming apparatus 1 (or the optical scanning unit 2). When the beam interval measurement is executed, the two light emitting elements that are to emit the two light beams indicated by the information stored in the memory are selected (set) as the two light emitting elements to be used in the beam interval measurement, in accordance with that information.

Figure 1A:
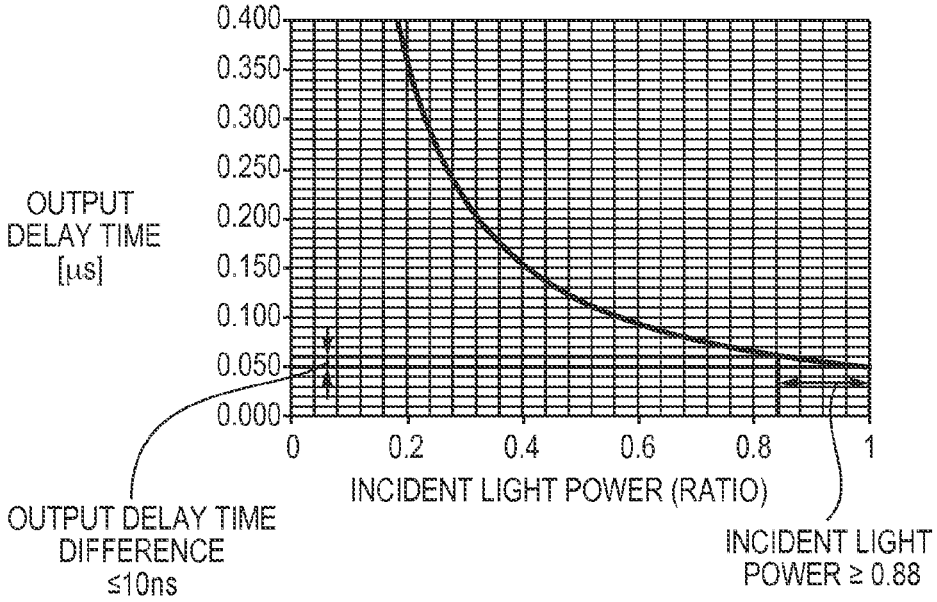
FIGS. 1A and 1B are diagrams for describing a method of selecting two light beams to be used in beam interval measurement, among multiple light beams from a semiconductor laser 11.

The method of selecting the light beams that are to be used in the beam interval measurement will be described first with reference to FIGS. 1A and 1B once again. FIG. 1A is a diagram showing a relationship between the delay time for a signal output from the optical sensor and the light power of the light beam that is incident on the optical sensor. Here, the number N of light emitting elements in the semiconductor laser 11 (i.e., the beam count) is 8. In the present embodiment, two light beams for which the difference, between the two light beams, in the output delay times of the BD signals output from the BD sensor 20 falls within a range of 10 [ns] or less are selected as the two light beams (leading beam and trailing beam) that are to be used in the beam interval measurement. In other words, the threshold value for the difference in the output delay times between the two light beams is set in advance as 10 [ns].

Figure 1B:
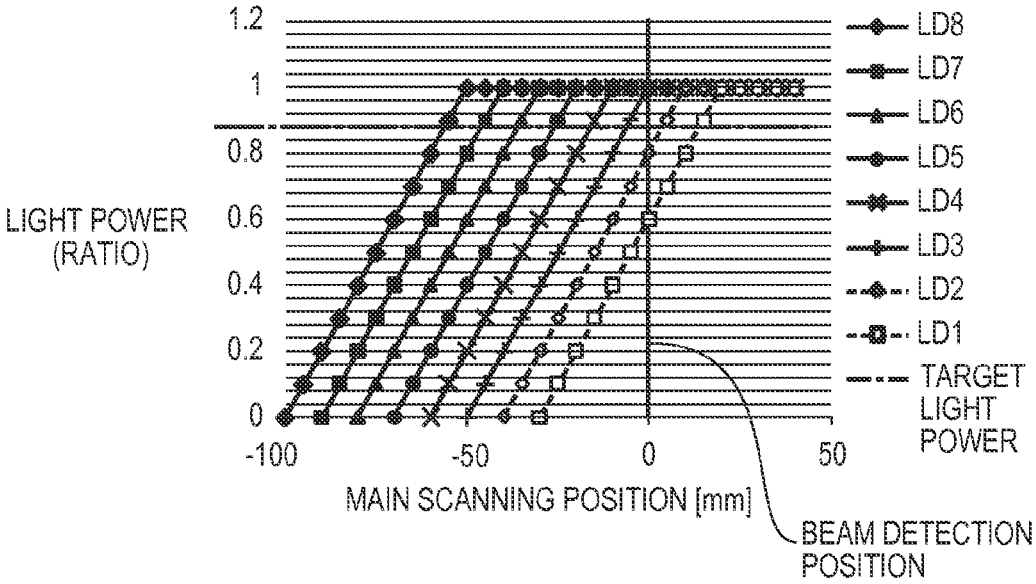

According to FIG. 1A, if the light power of one of the light beams (leading or trailing beam) is 100% (ratio of 1), the light power of the other light beam needs to be 88% or more (ratio of 0.88) in order to obtain an output delay time difference that is 10 [ns] or less. That is to say, two light beams for which the light power ratio between the beams falls within a range of 0.88 or more are selected for beam interval measurement. Here, as shown in FIG. 1B, when the target light power is set to 0.88, the light beams emitted from $LD_3$ to $LD_8$ are light beams detected by the BD sensor 20 that have light powers greater than or equal to the target light power at the beam detection position. On the other hand, the light beams emitted from $LD_1$ and $LD_2$ cannot achieve the target light power at the beam detection position. Accordingly, in the case where the optical scanning unit 2 has the characteristics shown in FIGS. 1A and 1B, the two light beams that are to be used in the beam interval measurement are selected from the light beams that correspond to $LD_3$ to $LD_8$.

Also, when selecting the two light beams that are to be used in the beam interval measurement, the two light beams need to be detected separately by the BD sensor 20, and therefore it is necessary to select two light beams that will not be incident on the BD sensor at the same time.

Figure 2:
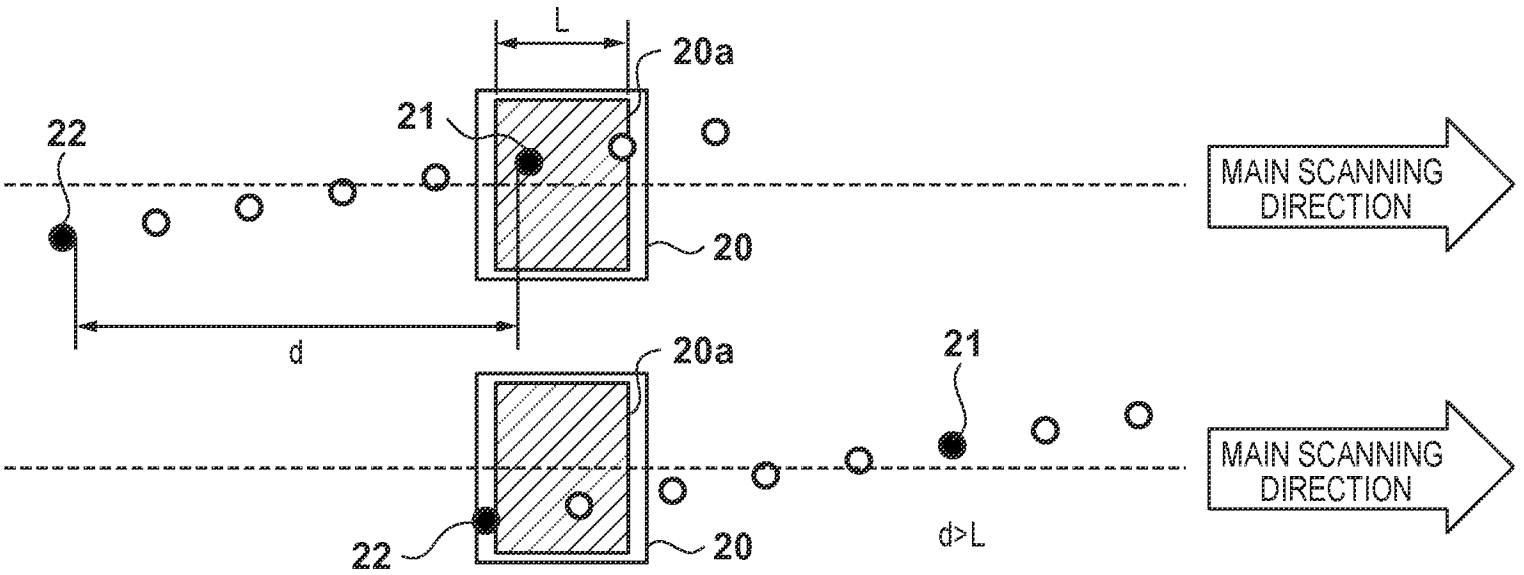
FIG. 2 is a diagram showing an example of scanning positions on a BD sensor 20 for all eight light beams from the semiconductor laser 11.

FIG. 2 is a diagram showing an example of the scanning positions on the BD sensor 20 for all eight light beams from the semiconductor laser 11. A condition for selecting two light beams that can be detected separately by the BD sensor 20 is that a distance d from the rear edge of the leading beam to the front edge of the trailing beam in the main scanning direction is longer than an effective light receiving width L in the main scanning direction on the light receiving surface 20*a* of the BD sensor 20. In the example shown in FIG. 2, the light beams are selected such that the leading beam and the trailing beam are separated by at least two beams in the main scanning direction.

As one example, in the present embodiment, a light beam 21 that corresponds to $LD_3$ and a light beam 22 that corresponds to $LD_8$ are set as the two light beams (leading beam and trailing beam) that are to be used in the beam interval measurement. Note that the measurement of the light power incident on the BD sensor 20 for the purpose of selecting the light beams for the beam interval measurement, the measurement of the beam interval distance d on the light receiving surface 20*a* of the BD sensor 20, and the like may be performed at the time of assembling the image forming apparatus 1 (optical scanning unit 2), for example.

Figure 3:
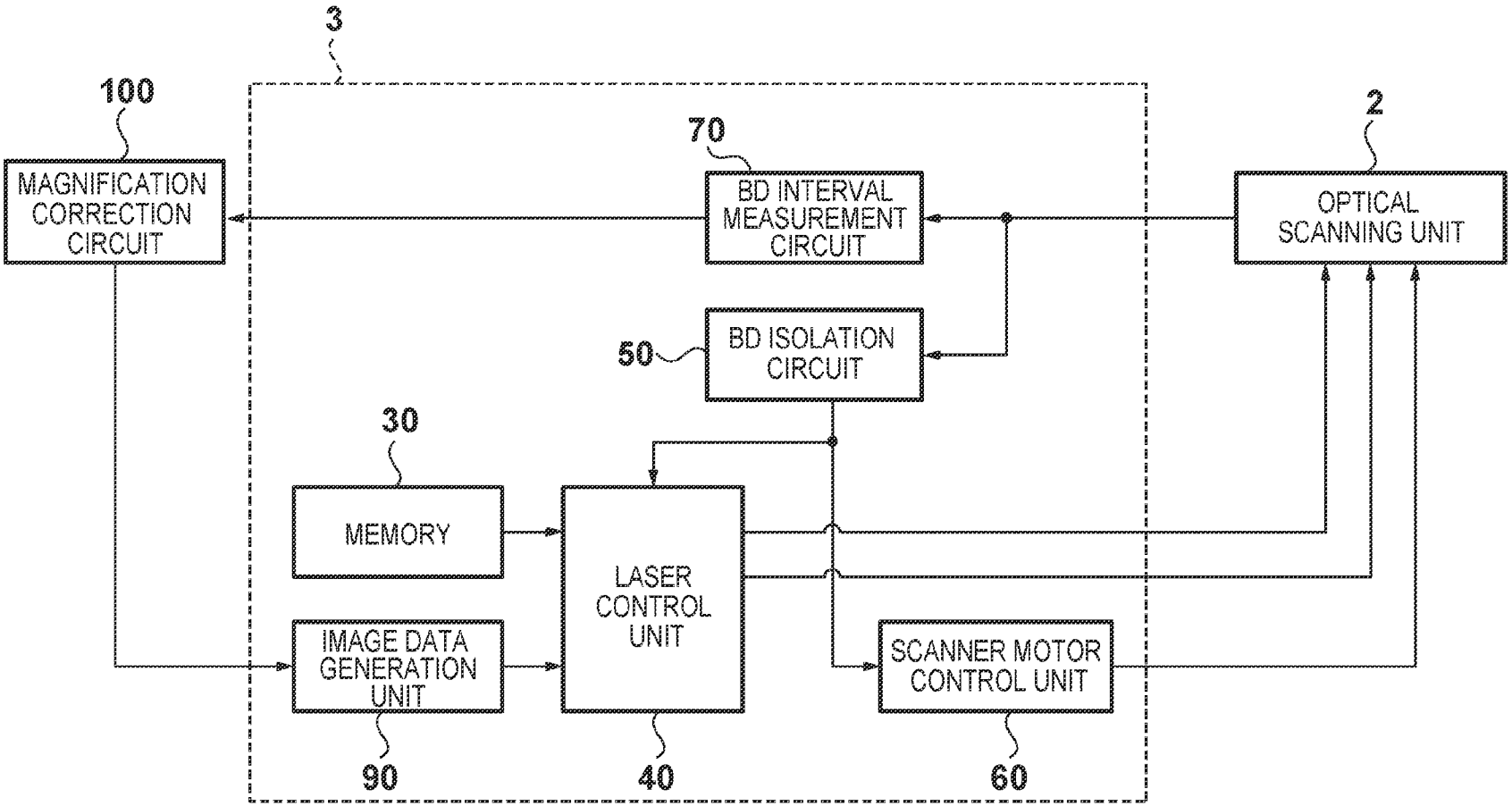
FIG. 3 is a block diagram showing a configuration of a scanner control unit 3 according to Embodiment 1.
Figure 4:
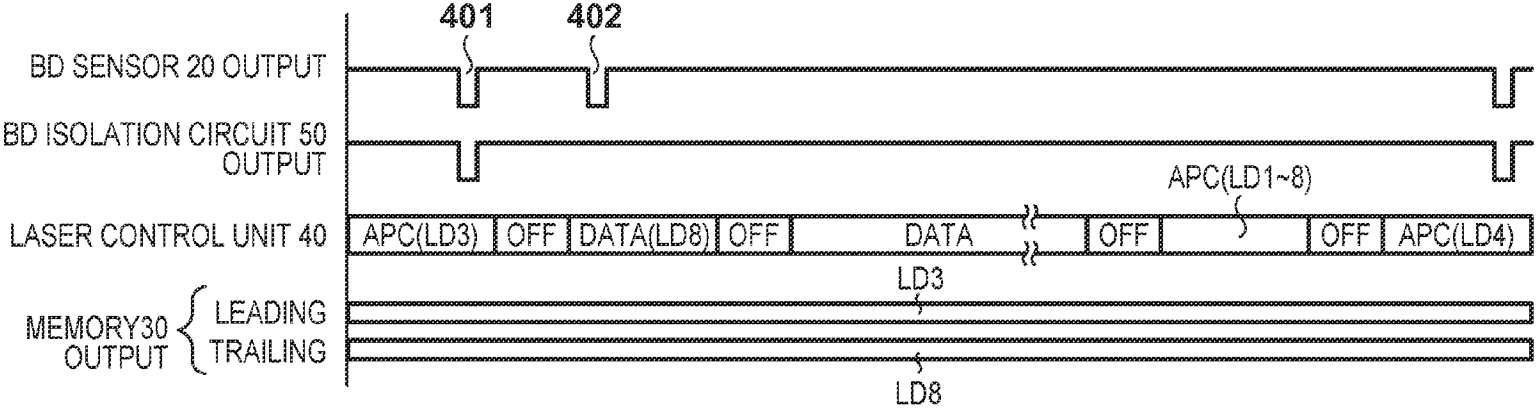
FIG. 4 is a timing chart showing the timing of operations performed by the scanner control unit 3 according to Embodiment 1.

FIG. 3 is a block diagram showing the configuration of the scanner control unit 3 according to the present embodiment, and FIG. 4 is a timing chart showing the timing of operations performed by the scanner control unit 3. As shown in FIG. 3, the scanner control unit 3 includes a memory 30, a laser control unit 40, a BD isolation circuit 50, a scanner motor control unit 60, a BD interval measurement circuit 70, and an image data generation unit 90, and the scanner control unit 3 is connected to the optical scanning unit 2 and a magnification correction circuit 100. Note that the scanner control unit 3 and the magnification correction circuit 100 may be incorporated in the optical scanning unit 2.

As shown in FIG. 4, the laser control unit 40 controls operations of the optical scanning unit 2. The laser control unit 40 has an APC mode, an OFF mode, and a DATA mode as operation modes. The APC mode is an operation mode in which the laser driving circuit 12 of the optical scanning unit 2 is controlled so as to perform the above-described APC on the LDs included in the semiconductor laser 11. The DATA mode is an operation mode in which image data is output (i.e., an image is formed on a recording medium). In the DATA mode, the laser control unit 40 controls the laser driving circuit 12 such that the semiconductor laser 11 is driven using a driving current determined by means of the APC. The OFF mode is an operation mode in which the laser driving circuit 12 is controlled so as to turn off the semiconductor laser 11.

Information indicating the two light beams (first and second light beams) that are to be used when performing beam interval measurement is stored in advance in the memory 30. The laser control unit 40 performs beam interval measurement using, as the leading beam and the trailing beam, the two light beams indicated by the information stored in advance in the memory 30. Note that as described above, the light beam output from the $LD_3$ is selected in advance as the leading beam that is to be used in beam measurement, the light beam output from $LD_8$ is selected in advance as the trailing beam that is to be used in beam measurement, and the information indicating these light beams is stored in the memory 30. In the present embodiment, the laser control unit 40 causes the leading beam and the trailing beam to be successively emitted from $LD_3$ and $LD_8$ at a predetermined time interval.

The laser control unit 40 detects the light beam output from $LD_3$ (leading beam) while operating in the APC mode for performing the APC for $LD_3$. The BD sensor 20 detects the leading beam in a state in which $LD_3$ is controlled using the APC so as to have a predetermined target light power and emit light. The BD sensor 20 outputs the BD signal 401 in response to the detection of the leading beam.

Also, the laser control unit 40 detects the light beam output from $LD_8$ (trailing beam) while operating in the DATA mode. The BD sensor 20 detects the trailing beam in a state in which $LD_8$ is constantly emitting light independent of image data (i.e., when being driven by a constant driving current). Measurement is performed using a constant driving current in this way in order to start $LD_8$ in a short amount of time. The BD sensor 20 outputs the BD signal 402 in response to the detection of the trailing beam.

The BD isolation circuit 50 retrieves only the BD signal corresponding to the leading beam from the BD signals output from the BD sensor 20, generates a signal corresponding to that BD signal, and outputs the signal to the laser control unit 40 and the scanner control unit 60. The laser control unit 40 and the scanner motor control unit 60 execute control operations using the rising edge of the signal supplied from the BD isolation circuit 50 as a reference.

Due to the leading beam and the trailing beam being successively emitted from $LD_3$ and $LD_8$ at the predetermined interval, BD signals 401 and 402 that correspond to the leading beam and the trailing beam are output from the BD sensor 20. The BD interval measurement circuit 70 measures the time interval between, for example, the falling edges (or rising edges) of the BD signals 401 and 402 output from the BD sensor 20. The BD interval measurement circuit 70 outputs the measurement result of the time interval to the magnification correction circuit 100 as a difference value.

Figure 5:
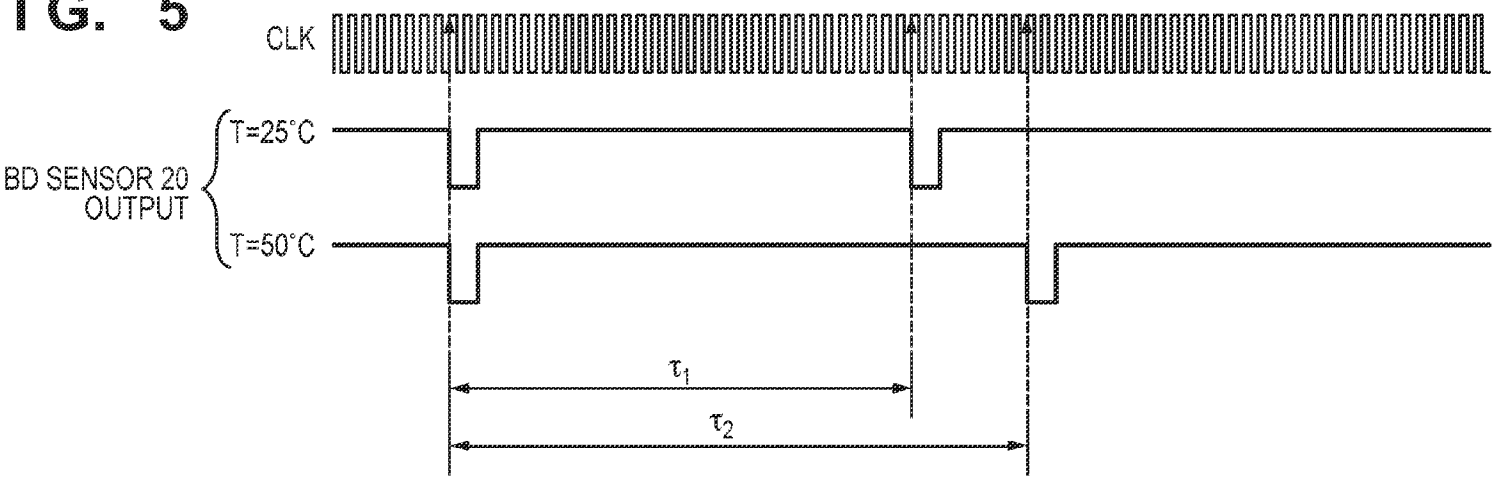
FIG. 5 is a timing chart showing the timing of operations performed by a BD interval measurement circuit 70 according to Embodiment 1.

FIG. 5 is a timing chart showing the timing of operations performed by the BD interval measurement circuit 70. The BD interval measurement circuit 70 uses a predetermined CLK signal to measure the time interval $\tau$ between the falling edges of the BD signals that correspond to the leading beam and the trailing beam and are emitted from the BD sensor 20. In FIG. 5, $\tau 1$ is obtained as the measurement value (difference value) for the time interval between the BD signals when temperature T=25° C., and $\tau 2$ is obtained when temperature T=50° C.

The magnification correction circuit 100 executes processing for adjusting the emission timings of the light emitting elements ($LD_1$ to $LD_8$) based on the difference value output from the BD interval measurement circuit 70. Specifically, the magnification correction circuit 100 generates a modulation clock based on the difference value output from the BD interval measurement circuit 70 and outputs the modulation clock to the image data generation unit 90. The image data generation unit 90 modulates image data using the modulation clock input from the magnification correction circuit 100 and outputs the modulated image data to the laser control unit 40 while the laser control unit 40 is operating in the DATA mode.

As described above, in the present embodiment, the two light beams that are to be used in the beam interval measurement are selected in advance and information indicating the two selected light beams is stored in advance in the memory 30 at the factory shipping time of the image forming apparatus 1 (or the optical scanning unit 2). Furthermore, the two light beams indicated by the information stored in the memory 30 are used to execute measurement when the beam interval measurement is executed. That is to say, the two light emitting elements that are to emit the two light beams to be used in the beam interval measurement are set by the laser control unit 40 in accordance with the information stored in the memory 30. These two light beams are selected in advance such that the ratio between the light powers when the light beams are incident on the BD sensor 20 falls within a predetermined range in which the beam interval measurement error can be reduced. According to the present embodiment, in the optical scanning unit 2 (optical scanning apparatus) that includes multiple light emitting elements, it is possible to suppress measurement errors when performing beam interval measurement and to improve the correction accuracy for the image writing start positions of the light emitting elements.

Embodiment 2

Embodiment 2 is a modified example of Embodiment 1 in which the light power of the light beams when performing the beam interval measurement, and the light power of the light beams when multiple light beams scan image regions on the photosensitive drums 25 in which electrostatic latent images are to be formed, are controlled so as to be different light powers. Note that portions that are different from Embodiment 1 will be described in particular below.

Figure 6A:
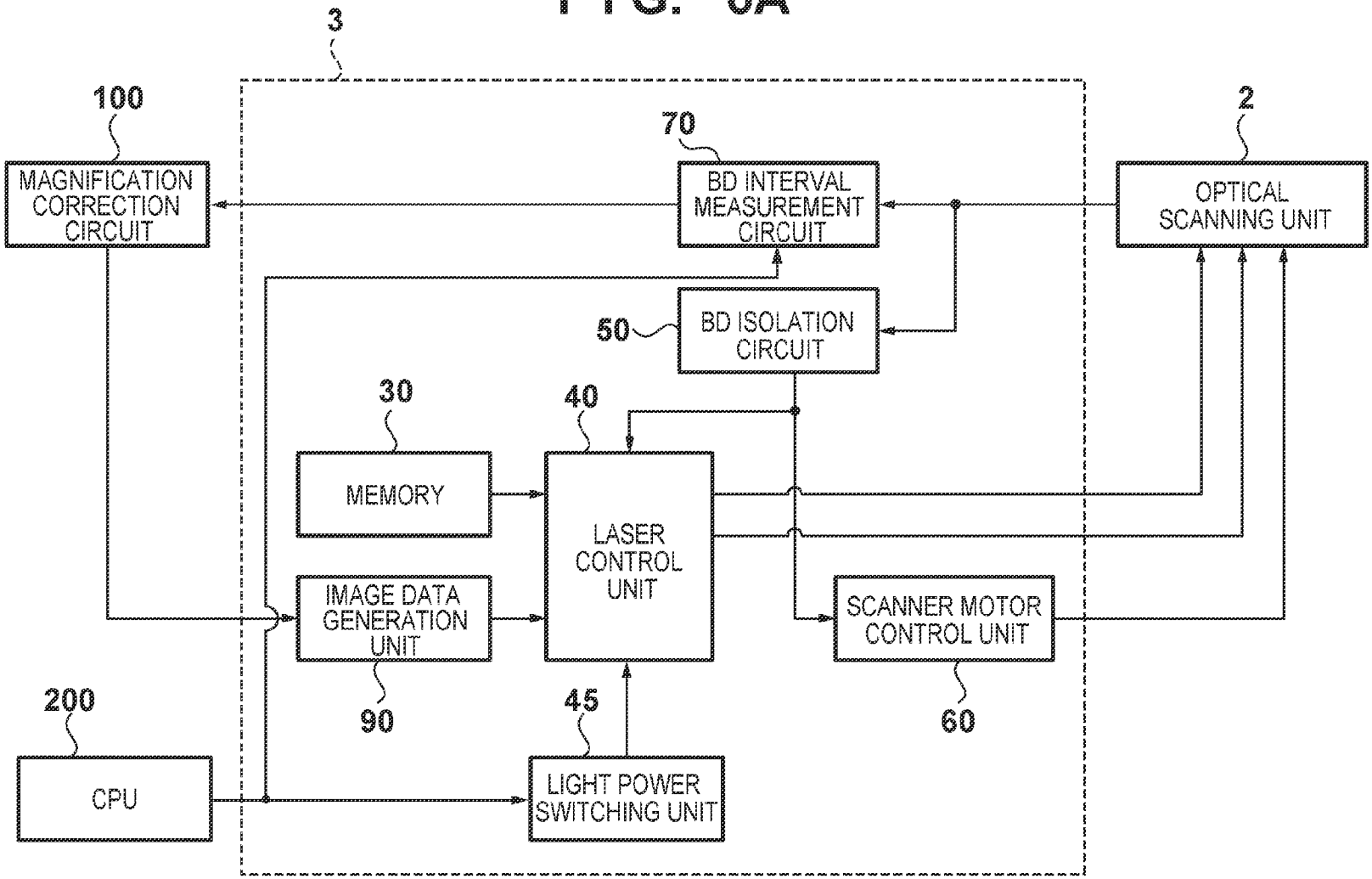
FIG. 6A is a block diagram showing a configuration of the scanner control unit 3 according to Embodiment 2.
Figure 6B:
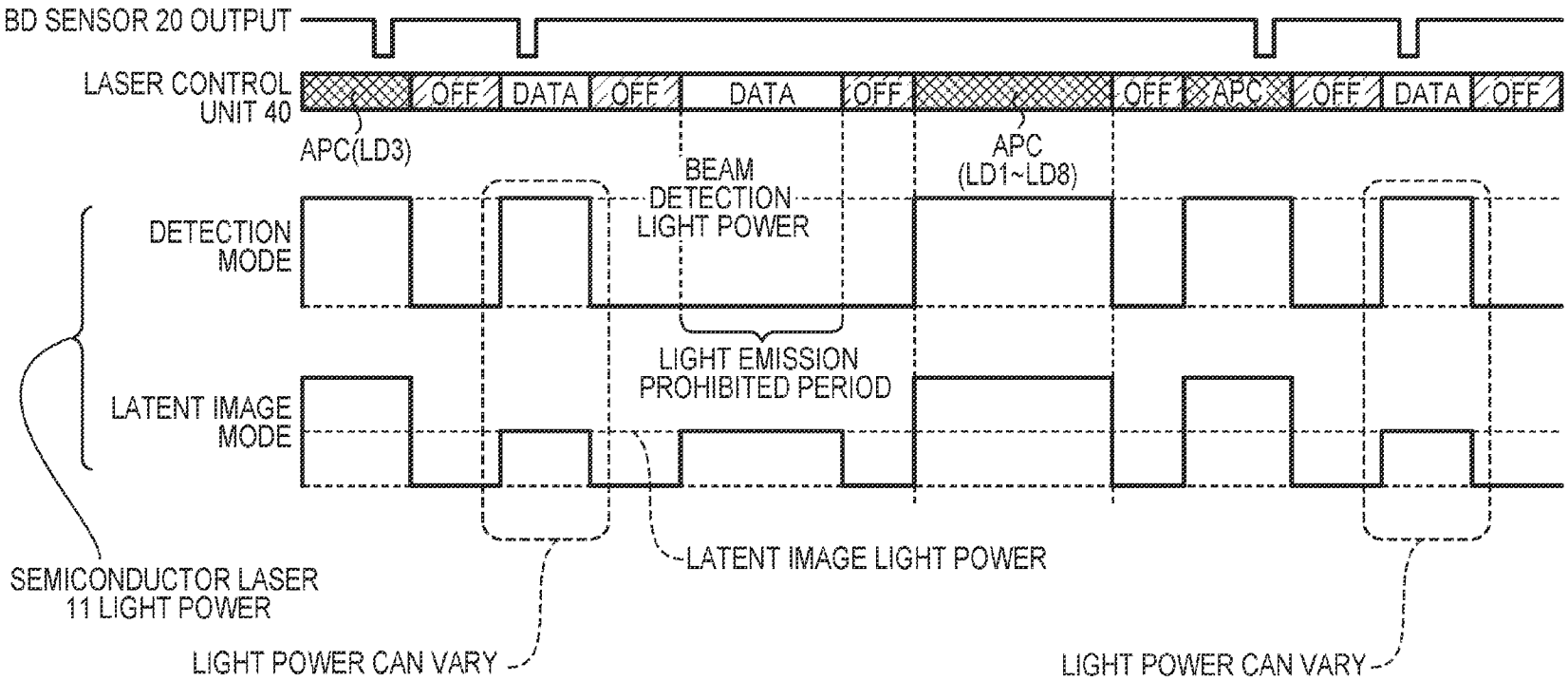
FIG. 6B is a timing chart showing the timing of operations performed by the scanner control unit 3 according to Embodiment 2.

FIG. 6A is a block diagram showing the configuration of the scanner control unit 3 according to the present embodiment, and FIG. 6B is a timing chart showing the timing of operations performed by the scanner control unit 3. The present embodiment differs from Embodiment 1 (FIG. 3) in that a CPU 200 is newly provided outside of the scanner control unit 3, and a light power switching unit 45 is newly provided inside of the scanner control unit 3. Note that the scanner control unit 3, the magnification correction circuit 100, and the CPU 200 may be incorporated in the optical scanning unit 2, similarly to the case of Embodiment 1.

In the present embodiment, as shown in FIG. 6B, the image forming apparatus 1 uses two operation modes, namely a "detection mode" in which beam interval measurement is performed, and a "latent image mode" in which an electrostatic latent image is formed on the photosensitive drum 25.

The "detection mode" is executed at the time of starting the power of the image forming apparatus 1, between sheets, or the like, for example. The CPU 200 controls the operation mode of the scanner control unit 3 (laser control unit 40) by means of a control signal that is input to the scanner control unit 3 (light power switching unit 45 and BD interval measurement circuit 70).

As shown in FIG. 6B, in the "detection mode", the laser control unit 40 sets the light power of the light beams emitted from $LD_3$ and $LD_8$ that are to be used in the beam interval measurement (leading beam and trailing beam) to a predetermined light power. Each light power is set to a light power that is different from the target light power that corresponds to the sensitivity of the corresponding photosensitive drum 25, and is used when the light beam scans the image region on the photosensitive drum 25 on which the electrostatic latent image is to be formed.

Also, as shown in FIG. 6B, in the "latent image mode", the laser control unit 40 controls the light powers of the light beams that are emitted from the light emitting elements so as to be light powers that are equal to the target light powers that correspond to the sensitivities of the photosensitive drums 25 in order to form electrostatic latent images on the photosensitive drums 25 (DATA mode). In this case, since the target light powers change according to the sensitivities of the photosensitive drums 25, there are cases where the light powers of the light emitting elements are different between the optical scanning units 2*a* to 2*d*.

The light power switching unit 45 inputs a switching signal to the laser control unit 40 so as to switch the light powers of the light emitting elements in the semiconductor laser 11 as described above according to whether the control signal from the CPU 200 indicates the "detection mode" or the "latent image mode". Also, the BD interval measurement circuit 70 operates such that the beam interval measurement is not performed in the case where the control signal from the CPU 200 indicates the "latent image mode".

Note that as shown in FIG. 6B, in the "detection mode", the laser control unit 40 may control the optical scanning unit 2 so as to prevent light beams with excessive light power from being incident on the photosensitive drums 25, by prohibiting the emission of light from the light emitting elements in the semiconductor laser 11.

According to the present embodiment, in the optical scanning unit 2 (optical scanning apparatus) that includes multiple light emitting elements, it is possible to suppress measurement errors when performing beam interval measurement and it is possible to improve the correction accuracy for the image writing start positions of the light emitting elements, similarly to the case of Embodiment 1. Furthermore, the light power of the light beams emitted from the semiconductor laser 11 can be appropriately controlled according to the operation mode of the image forming apparatus 1.

Embodiment 3

In Embodiment 3, the light power when the light beams that have been emitted from the light emitting elements ($LD_1$ to $LD_8$) of the semiconductor laser 11 are incident on the BD sensor 20 is measured, and the two light beams that are to be used in the beam interval measurement (first and second light beams) are selected based on the results of the measurement. Note that portions that are different from Embodiments 1 and 2 will be described in particular below.

Figure 7A:
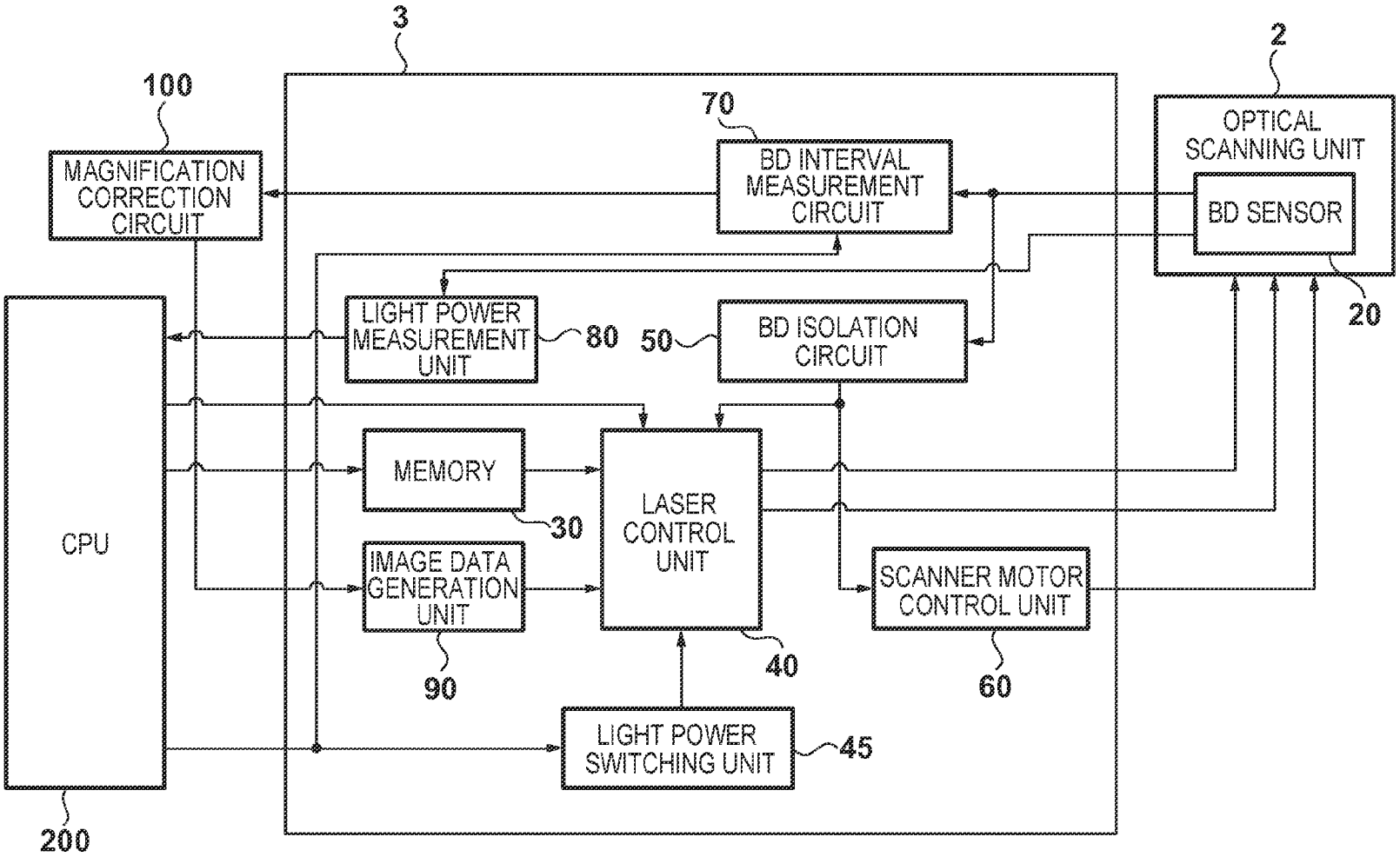
FIG. 7A is a block diagram showing a configuration of the scanner control unit 3 according to Embodiment 3.

FIG. 7A is a block diagram showing the configuration of the scanner control unit 3 according to the present embodiment. The present embodiment differs from Embodiment 2 (FIG. 6A) in that a light power measurement unit 80 is newly provided inside of the scanner control unit 3. Note that the scanner control unit 3, the magnification correction circuit 100, and the CPU 200 may be incorporated in the optical scanning unit 2, similarly to the cases of Embodiments 1 and 2.

Figure 7B:
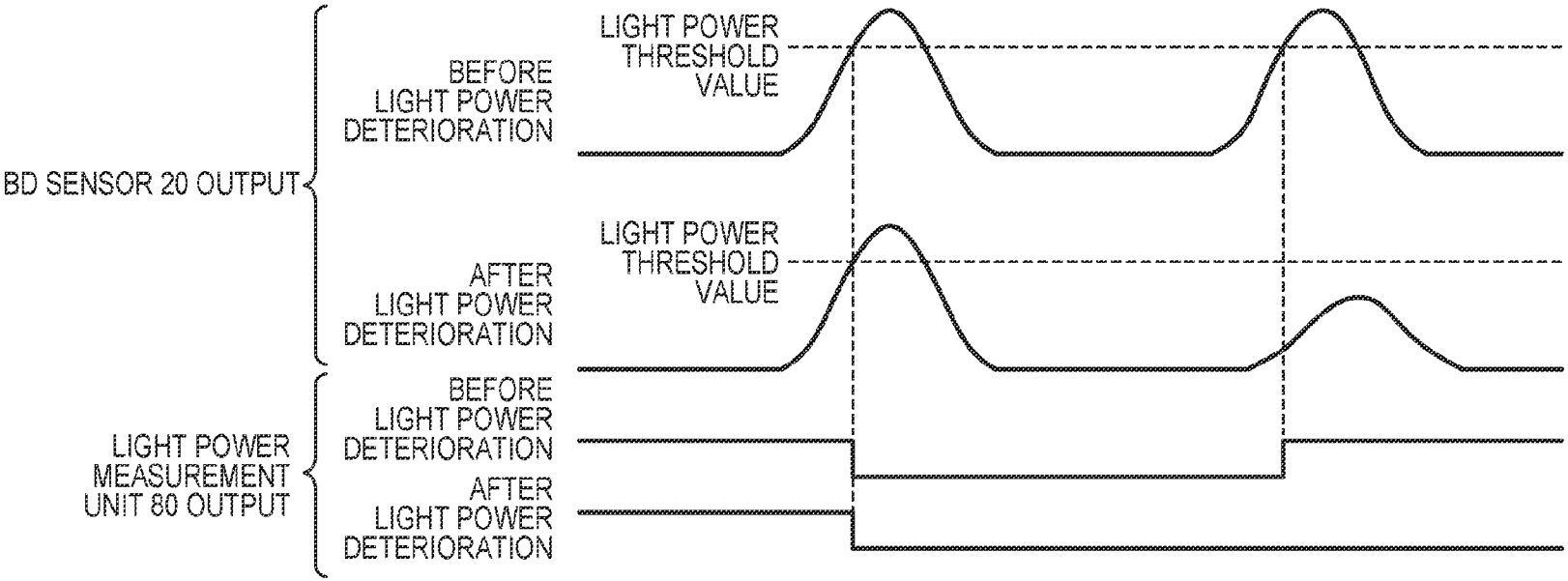
FIG. 7B is a diagram for describing beam selection processing according to Embodiment 3.

In the present embodiment, the BD sensor 20 in the optical scanning unit 2 is connected not only to the BD interval measurement circuit 70, but also to the light power measurement unit 80. Based on the output from the BD sensor 20, the light power measurement unit 80 measures the light power when the light beams that have been emitted from the light emitting elements ($LD_1$ to $LD_8$) in the semiconductor laser 11 are incident on the BD sensor 20, and outputs the measurement results to the CPU 200. FIG. 7B shows an example of an output signal that is output from the light power measurement unit 80 to the CPU 200. A signal indicating the result of comparing the output from the BD sensor 20 and a threshold value set by the CPU 200 is output by the light power measurement unit 80 to the CPU 200. As shown in FIG. 7B, if the output (light power) from the BD sensor 20 is at or above the threshold value, the light power measurement unit 80 switches the level of the output signal that can have one of two values, and if the output (light power) from the BD sensor 20 is less than the threshold value, the light power measurement unit 80 does not change the level of the output signal.

The CPU 200 performs control for causing the light emitting elements ($LD_1$ to $LD_8$) of the semiconductor laser 11 to emit light at a predetermined selection timing for selecting the light beams to be used in the beam interval measurement. Furthermore, based on the measurement result output by the light power measurement unit 80, the CPU 200 selects (sets) the two light beams to be used in the beam interval measurement (first and second light beams) and stores the information indicating the two selected light beams in the memory 30. Specifically, the CPU 200 specifies the combination of two light beams for which the ratio between the light powers measured using the light power measurement unit 80 falls within a predetermined range (the range that was described in Embodiment 1). Furthermore, the CPU 200 selects these two light beams as the two light beams that are to be used in the beam interval measurement. That is to say, the CPU 200 sets the light emitting elements that emit these two light beams as the light emitting elements that are to emit the first and second light beams. At the time of beam interval measurement, the laser control unit 40 selects the two light beams to be used in the measurement, based on the information stored in the memory 30, similarly to the cases of Embodiments 1 and 2.

Note that similarly to Embodiment 1, the CPU 200 selects two light beams for which the ratio between the light powers measured by the light power measurement unit 80 falls within a predetermined range (the range that was described in Embodiment 1), and that are not incident on the light-receiving surface 20*a* of the BD sensor 20 at the same time.

Figure 7C:
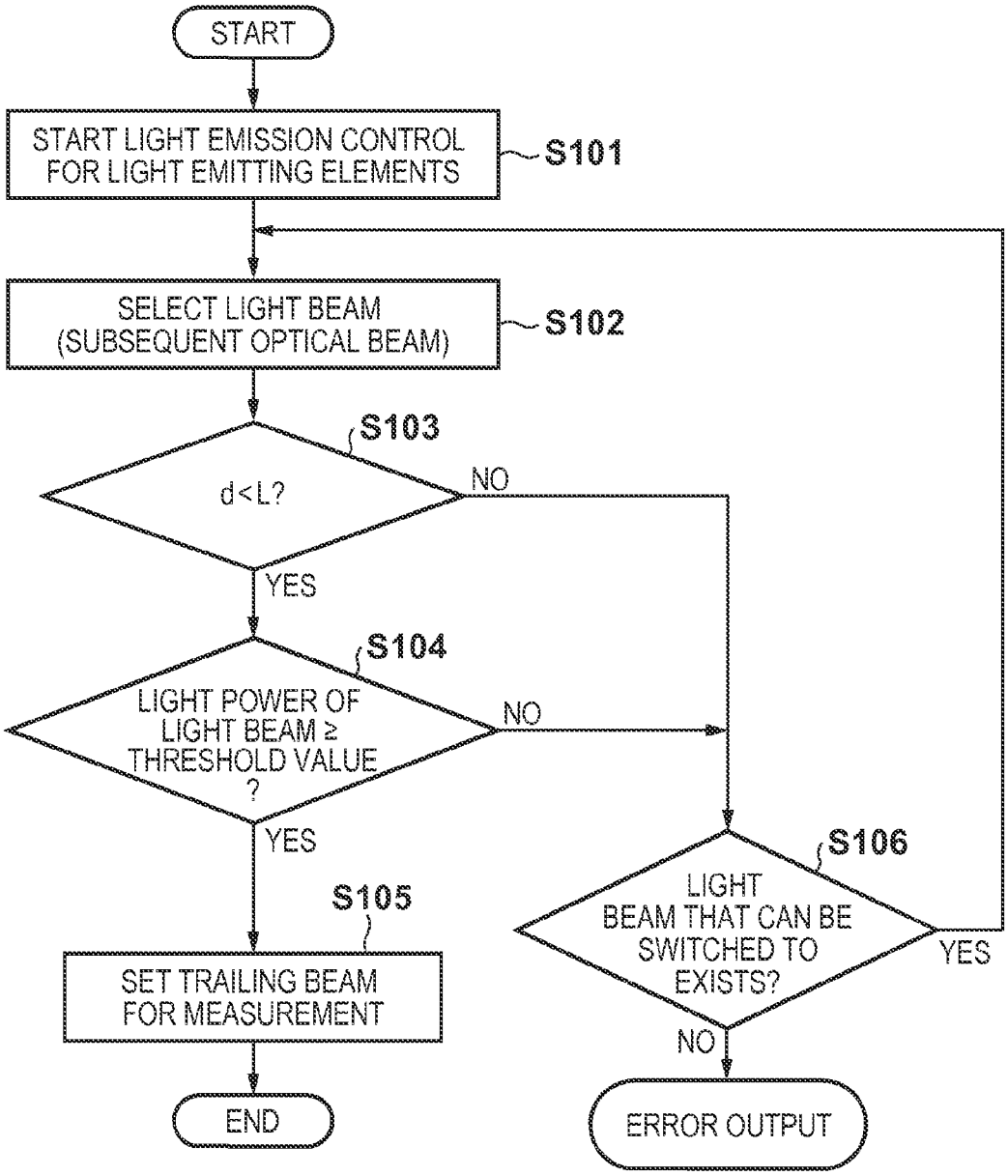
FIG. 7C is a flowchart showing a procedure for beam selection processing according to Embodiment 3.

FIG. 7C is a flowchart showing a procedure of beam selection processing executed by the CPU 200. Note that the processing of the steps in this flowchart is realized in the image forming apparatus 1 (optical scanning unit 2) by the CPU 200 reading out a control program stored in a memory such as a ROM (not shown) to a RAM (not shown) and executing it.

Upon reaching the predetermined selection timing, the CPU 200 starts light emission control for the semiconductor laser 11 in step S101. For example, the CPU 200 causes the light emitting elements ($LD_1$ to $LD_8$) of the semiconductor laser 11 to successively emit light. At this time, the CPU 200 controls the laser control unit 40 via the light power switching unit 45 such that the light emitting elements emit light at predetermined light powers.

The CPU 200 causes the light emitting elements to successively emit light, and sets, as the leading beam for the beam interval measurement, a light beam for which a light power measured by the light power measurement unit 80 becomes greater than or equal to the predetermined threshold value first. Furthermore, based on the light power that has been measured for the set leading beam, the CPU 200 sets the light power threshold value for setting the trailing beam. For example, a value that is obtained by multiplying the light power of the leading beam by 0.88 is set as the threshold value such that the ratio between the light powers of the leading beam and the trailing beam falls within a range of being 0.88 or more, similarly to Embodiment 1. The CPU 200 outputs the set threshold value to the light power measurement unit 80.

Next, in step S102, after setting the leading beam for measurement, the CPU 200 selects a light beam (the subsequent light beam) that is to be a trailing beam candidate. Furthermore, in step S103, the CPU 200 determines whether or not the light beam satisfies d<L as described in Embodiment 1, and if it does not satisfy that condition, the procedure moves to the processing of step S106, and if it does satisfy that condition, the procedure moves to the processing of step S104. In step S106, the CPU 200 determines whether or not a light beam that can be switched to remains, and if it does, the procedure returns to the processing of step S102, and if not, the CPU 200 outputs error information indicating that a light beam for beam interval measurement cannot be selected, and ends the processing.

On the other hand, in step S104, the CPU 200 causes the light emitting element corresponding to the selected light beam to emit light, and based on the output signal from the light power measurement unit 80, determines whether or not the light power of the light beam is greater than or equal to the threshold value. Here, if the light power of the light beam is greater than or equal to the threshold value, the CPU 200 sets the light beam as the trailing beam for measurement in step S105 and ends the processing. On the other hand, if the light power of the light beam is less than the threshold value, the procedure moves to the processing of step S106, where the CPU 200 determines whether or not a light beam that can be switched to remains, and if it does, the CPU 200 returns to the processing of step S102.

As described above, the trailing beam for the beam interval measurement is determined in step S105 by repeating the processing of steps S102 to S104 and step S106.

In the present embodiment, the two light beams for beam interval measurement are selected dynamically according to the light powers of the light beams detected by the BD sensor 20. According to this, it is possible to execute the beam interval measurement using appropriate light beams that are selected according to the state of the image forming apparatus 1 (optical scanning unit 2).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-137468, filed Jun. 28, 2013, which is hereby incorporated by reference herein in its entirety.

What is claimed is:

1. An image forming apparatus that exposes a photosensitive member using a plurality of light beams, the image forming apparatus comprising:

a light source that includes a plurality of light emitting elements that each emit a light beam, the light source including at least three light emitting elements;

a deflection unit configured to deflect the plurality of light beams emitted from the plurality of light emitting elements, such that the plurality of light beams scan the photosensitive member;

a detection unit that is provided on a scanning path of the plurality of light beams deflected by the deflection unit, and is configured to output a detection signal indicating that a light beam deflected by the deflection unit has been detected due to the light beam being incident on the detection unit;

a measurement unit configured to control the light source such that a first and second light beam are successively incident on the detection unit, and to measure a time interval between detection signals that are output from the detection unit and corresponds to the first and second light beams; and a control unit configured to, according to the time interval measured by the measurement unit, control relative emission timings for light beams from the plurality of light emitting elements that are based on image data, wherein among the plurality of light emitting elements, two light emitting elements are set as light emitting elements that are to emit the first and second light beams, the two light emitting elements outputting two light beams for which a ratio between light powers of the two light beams detected by the detection unit falls within a predetermined range, and wherein the image forming apparatus further comprises:

a storage unit configured to store information indicating the first and second light beams that are to be used at a time of the measurement performed by the measurement unit and that are selected in advance based on light power measurement results when the light beams emitted from the plurality of light emitting elements are incident on the detection unit; and a setting unit configured to, in accordance with the information stored in the storage unit, set the two light emitting elements that are to emit the first and second light beams.

2. The image forming apparatus according to claim 1, wherein the control unit controls emission timings for the plurality of light emitting elements such that writing start positions, of electrostatic latent images, in a main scanning direction for respective light beams.

3. The image forming apparatus according to claim 1, wherein the information indicating the first and second light beams is stored in advance in the storage unit.

4. The image forming apparatus according to claim 1, wherein the predetermined range is determined as a range in which a difference in output delay times between the two light beams is less than or equal to a predetermined threshold value, the output delay times occurring in the detection signals according to a change in a light power of a light beam when the light beam is incident on the detection unit.

5. The image forming apparatus according to claim 1, further comprising:

the photosensitive member;

a charging unit configured to charge the photosensitive member; and a developing unit configured to form an image that is to be transferred onto a recording medium on the photosensitive member by developing an electrostatic latent image that is formed on the photosensitive member by exposure performed using the plurality of light beams.

6. An image forming apparatus that exposes a photosensitive member using a plurality of light beams, the image forming apparatus comprising:

a light source that includes a plurality of light emitting elements that each emit a light beam, the light source including at least three light emitting elements;

a deflection unit configured to deflect the plurality of light beams emitted from the plurality of light emitting elements, such that the plurality of light beams scan the photosensitive member;

a detection unit that is provided on a scanning path of the plurality of light beams deflected by the deflection unit, and is configured to output a detection signal indicating that a light beam deflected by the deflection unit has been detected due to the light beam being incident on the detection unit;

a measurement unit configured to control the light source such that a first and second light beam are successively incident on the detection unit, and to measure a time interval between detection signals that are output from the detection unit and corresponds to the first and second light beams; and a control unit configured to, according to the time interval measured by the measurement unit, control relative emission timings for light beams from the plurality of light emitting elements that are based on image data, wherein among the plurality of light emitting elements, two light emitting elements are set as light emitting elements that are to emit the first and second light beams, the two light emitting elements outputting two light beams for which a ration between light powers of the two light beams detected by the detection unit falls within a predetermined range, and wherein the image forming apparatus further comprises:

a light power measurement unit configured to measure a light power when a light beam emitted from each of the plurality of light emitting elements is incident on the detection unit; and a setting unit configured to specify, among the plurality of light beams, a combination of two light beams for which the ratio between light powers measured by the light power measurement unit falls within the predetermined range, and to set two light emitting elements that emit the two light beams in the specified combination as light emitting elements that are to emit the first and second light beams.

7. The image forming apparatus according to claim 6, wherein among the plurality of light beams, the setting unit specifies a combination of two light beams that are not incident on a light-receiving surface of the detection unit simultaneously and for which the ratio between the light powers measured by the light power measurement unit falls within the predetermined range, and sets two light emitting elements that emit the two light beams in the specified combination as light emitting elements that are to emit the first and second light beams.

8. The image forming apparatus according to claim 7, wherein the two light beams that are not incident on the light-receiving surface simultaneously are two light beams for which an interval therebetween in the main scanning direction when the plurality of light beams scans the photosensitive member is larger than a width of the light-receiving surface in the main scanning direction.

9. An image forming apparatus that exposes a photosensitive member using a plurality of light beams, the image forming apparatus comprising:

a light source that includes a plurality of light emitting elements that each emit a light beam, the light source including at least three light emitting elements;

a detection unit configured to deflect the plurality of light beams emitted from the plurality of light emitting elements, such that the plurality of light beams scan the photosensitive member;

a detection unit that is provided on a scanning path of the plurality of light beams deflected by the deflection unit, and is configured to output a detection signal indicating that a light beam deflected by the deflection unit has been detected due to the light beam being incident on the detection unit;

a measurement unit configured to control the light source such that a first and second light beam are successively incident on the detection unit, and to measure a time interval between detection signals that are output from the detection unit and corresponds to the first and second light beans; and a control unit configured to, according to the time interval measured by the measurement unit, control relative emission timings for light beams from the plurality of light emitting elements that are based on image data, wherein among the plurality of light emitting elements, two light emitting elements are set as light emitting elements that are to emit the first and second light beams, the two light emitting elements outputting two light beams for which a ratio between light powers of the two light beams detected by the detection unit falls within a predetermined range, and wherein the image forming apparatus further comprises:

a light power control unit configured to control a light power of each of the light beams that are to be emitted from the plurality of light emitting elements, wherein in a case where the plurality of light beams scan an image region on the photosensitive member in which an electrostatic latent image is to be formed, the light power control unit controls the light power of each of the light beams so as to be a light power that is equal to a target light power that corresponds to a sensitivity of the photosensitive member, and in a case where the time interval measurement is executed by the measurement unit, the light power control unit controls the light power of each of the first and second light beams so as to be a predetermined light power that is different from the target light power.

* * * * *